United States Patent [19]

Daman

[11] 4,250,839

[45] Feb. 17, 1981

[54] VAPOR GENERATOR UTILIZING STACKED FLUIDIZED BED AND A WATER-COOLED HEAT RECOVERY ENCLOSURE

[75] Inventor: Ernest L. Daman, Westfield, N.J.

[73] Assignee: Foster Wheeler Energy Corporation, Livingston, N.J.

[21] Appl. No.: 16,264

[22] Filed: Feb. 28, 1979

[51] Int. Cl.[3] ..... F22B 1/02

[52] U.S. Cl. ..... 122/4 D; 110/263

[58] Field of Search ..... 122/4 D; 110/245, 263; 431/7, 170

[56] References Cited

U.S. PATENT DOCUMENTS

| | | | |
|---|---|---|---|
| 3,823,693 | 7/1974 | Bryers et al. | 122/4 D |
| 4,154,197 | 5/1979 | Costello et al. | 122/4 D |

*Primary Examiner*—Edward G. Favors

*Attorney, Agent, or Firm*—Marvin A. Naigur; John E. Wilson; John J. Herguth, Jr.

[57] ABSTRACT

A vapor generator in which a plurality of vertically aligned fluidized beds are disposed in a furnace section with one of the boundary walls of the furnace section having openings therein for permitting the discharge of effluent gases from the fluidized beds. A heat recovery enclosure is formed adjacent said furnace section and shares a common wall with the furnace section for receiving the effluent gases, and a convection enclosure is disposed adjacent the heat recovery enclosure and shares a common wall with the latter enclosure for receiving the effluent gases from the heat recovery enclosure. The boundary walls of the furnace section, the heat recovery enclosure and the convection enclosure are formed by a plurality of interconnected tubes through which fluid is passed in a predetermined sequence to transfer heat from the fluidized beds to the fluid.

27 Claims, 2 Drawing Figures

VAPOR GENERATOR UTILIZING STACKED FLUIDIZED BED AND A WATER-COOLED HEAT RECOVERY ENCLOSURE

BACKGROUND OF THE INVENTION

This invention relates to a fluidized bed heat exchanger, and more particularly, to a vapor generator which consists of a plurality of stacked fluidized beds for generating heat.

The use of a low-grade solid fuel, such as coal, is a well-known source of heat in the use of generation of steam. In some of these arrangements the fuel is disposed in a fixed bed with a chain grate stoker or the like utilized to promote its combustion, and water is passed in a heat exchange relation thereto to produce the steam. However, these arrangements suffer from several disadvantages including problems in handling the solid fuel while adding it to or removing it from the beds during operation. Also, a relatively low heat transfer is achieved and the bed temperatures are often nonuniform and hard to control.

Attempts have been made to utilize a fluidized bed to produce heat for generating steam due to the fact that a fluidized bed enjoys the advantages of an improved heat transfer rate, a reduction in corrosion, a reduction in boiler fouling, a reduction in sulfur dioxide emission, a relatively low combustion temperature and a reduction in boiler size. In these arrangements, air is passed upwardly through a mass of particulate fuel material causing the material to expand and take on a suspended or fluidized state. However, there is an inherent limitation on the range of heat input to the water passing in a heat exchange relation to the fluidized bed, largely due to the fact that the quantity of air supplied to the bed must be sufficient to maintain same in a fluidized condition yet must not cause excessive quantities of the fuel material to be blown away.

This disadvantage is largely overcome by the arrangement disclosed in U.S. Pat. No. 3,823,396 issued to Bryers and Shenker on July 16, 1974, and assigned to the same assignee as the present application. In the arrangement disclosed in the latter patent, the furnace section of the generator was formed by a plurality of vertically aligned chambers, or cells, each containing a fluidized bed. The fluid to be heated was passed upwardly through the fluidized beds in a heat exchange relation thereto to gradually raise the temperature of the fluid. A tube bundle was placed in the area above each bed to provide a convection surface for the effluent gases from each bed.

However, in this type of arrangement the volume of space available above each bed to receive the convection surface is relatively small due to limitations placed on the cross-sectional area of each cell caused by tube spacings, welding accessibility, dust clogging, combustion requirements, etc. As a result, the convection surface defined by the tube bundles was limited to an extent that the mass flow of the effluent gases per area of convection surface and the resulting heat transfer coefficient above each bed, was far less than optimum.

SUMMARY OF THE INVENTION

It is therefore an object of the present invention to provide a heat exchanger which enjoys the advantages of the stacked fluidized bed design yet provides a convection heat transfer surface of optimum value.

It is a further object of the present invention to provide a vapor generator of the above type in which a water cooled heat recovery enclosure is provided adjacent the furnace section of the vapor generator for providing an extended convection surface.

It is a still further object of the present invention to provide a vapor generator of the above type in which a water cooled, heat recovery enclosure is provided between the furnace section and the convection section of the vapor generator and shares a common wall with each.

DESCRIPTION OF THE PREFERRED EMBODIMENTS

Figure 1:
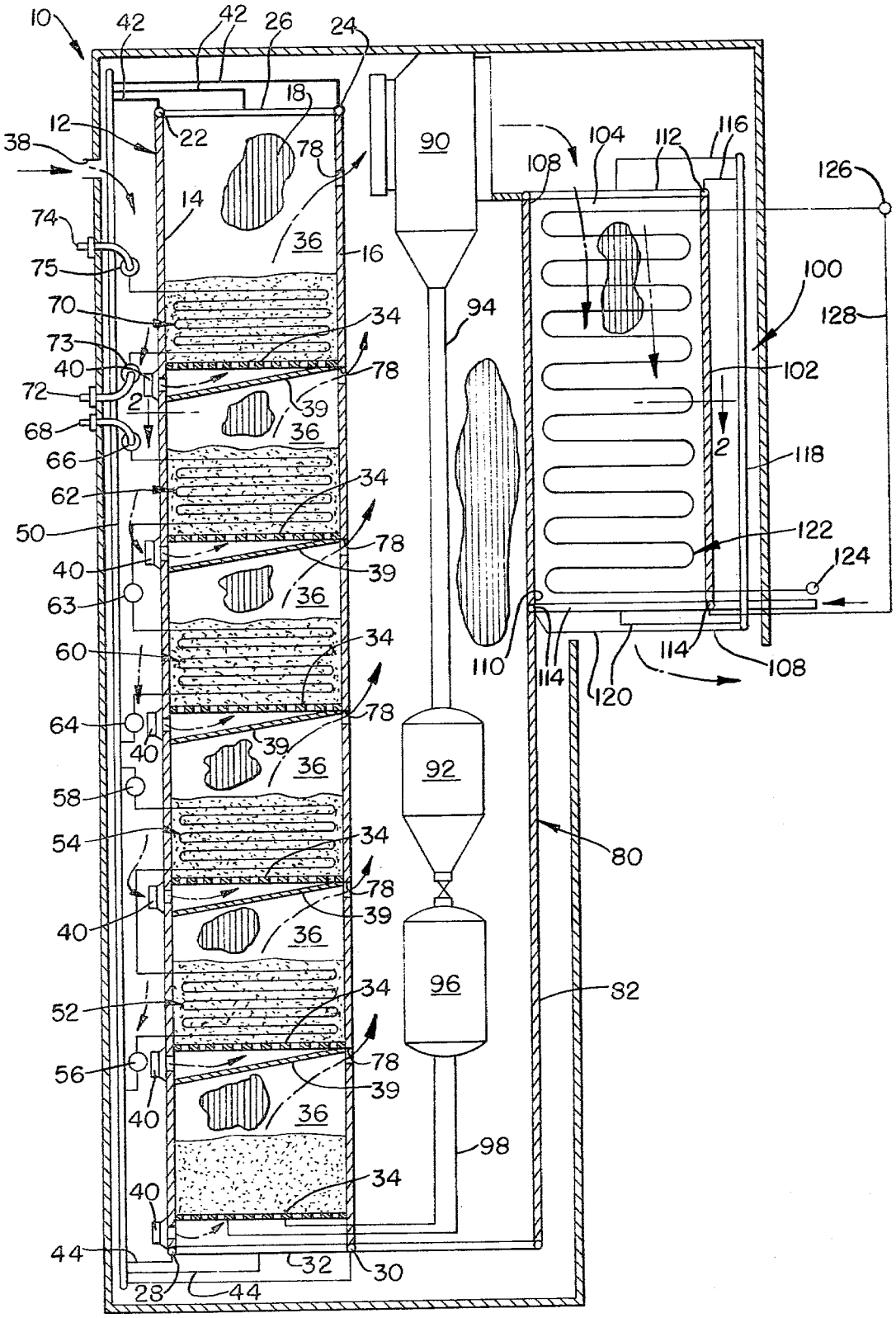
FIG. 1 is a schematic vertical sectional view of the vapor generator of the present invention.

The vapor generator of the present invention is shown in detail in FIG. 1 of the drawings, with the reference numeral 10 referring in general to a housing formed in a conventional manner by refractory material and other structural support material. A furnace section 12 is disposed within the housing 10 and comprises a front wall 14 and a rear wall 16 shown in cross-section, with each wall being formed by a plurality of vertical tubes having continuous fins disposed on diametrically opposed portions thereof and extending for the length thereof, with the fins of adjacent tubes being welded together in a conventional manner to form a gas-tight wall. The furnace section 12 also includes a pair of sidewalls 18 and 20 which extend perpendicular to the front wall 14 and rear wall 16 with the sidewall 18 being shown in FIG. 1 and with both sidewalls 18 and 20 being shown in FIG. 2. It is understood that the sidewalls 18 and 20 are constructed in an identical manner to that of the walls 14 and 16.

A pair of headers, shown in end view by the reference numerals 22 and 24, are provided at the top of the furnace section 12 and communicate with the tubes forming the walls 14 and 16 respectively. A header 26 is also provided at the top of the enclosure 12 and communicates with the tubes forming the sidewall 18, it being understood that another header similar to the header 26 will be provided in communication with the sidewall 20. In a similar manner, headers 28, 30 and 32 are disposed at the bottom of the furnace section 12 in communication with the tubes forming the walls 14, 16 and 18, respectively, it also being understood that an additional header is provided in the bottom of the enclosure in communication with the sidewall 20.

A plurality of horizontal perforated air distribution plates 34 are disposed in a spaced relation in the furnace section 12 to divide the latter into a plurality of vertically stacked compartments, each designated by the reference numeral 36.

An air inlet 38 is provided through the front wall 14 of the furnace section 12 and an air plenum chamber 39 extends below each of the plates 34 for distributing the air to the compartments 36, with the flow being controlled by dampers 40 or the like disposed in openings extending through the front wall 12.

It is understood that a multiplicity of feed lines or the like (not shown) communicate with each compartment 36 and are adapted to receive particulate fuel from an external source such as a pneumatic feeder, or the like, and discharge same into each compartment. An inert material is also disposed in each compartment 36 and, together with the particulate fuel material, forms a bed of material in each compartment which is fluidized by the air passing upwardly through the plates 34 and into each bed.

A plurality of feeder tubes 42 are connected to the headers 22, 24, and 26, at the upper portion of the enclosure 12 while a plurality of feeder tubes 44 are connected to the headers 24 and 26 at the lower portion of the enclosure. Although not shown in the drawings, it is understood that additional feeder tubes are provided which are connected to the headers associated with the sidewall 20.

Each feeder tube 42 and 44 is connected to a respective downcomer conduit, one of which is shown by the reference numeral 50, it being understood that several additional downcomer conduits extend immediately behind the downcomer conduit 50 as viewed in FIG. 1 and are similar thereto. The headers associated with each wall as well as the feeder tubes and downcomers enable the water to be passed in a predetermined sequence through the walls to add heat to the water as will be explained in detail later.

A pair of tube bundles 52 and 54 are respectively disposed in two adjacent compartments 36 within the enclosure 12 and are connected in series between a pair of headers 56 and 58, respectively, which, in turn, are connected, by means of feeder tubes, to separate downcomer conduits, similar to and extending behind the downcomer conduit 50.

In a similar manner, an additional pair of tube bundles 60 and 62 are respectively disposed in adjacent compartments 36 above the tube bundles 52 and 54 and are connected in series via a header 63. The tube bundle 60 is connected, via a header 64, to a downcomer conduit extending to the rear of the downcomer conduit 50, and the tube bundle 62 is connected via a header 66 to an outlet conduit 68.

A tube bundle 70 is provided in the uppermost compartment 36 and is connected to an inlet conduit 72 via a header 73 and to an outlet conduit 74 via a header 75. Each tube bundle 52, 54, 60, 62, and 70 consists of a plurality of tubes each disposed in a serpentine manner, it being understood that, although only a single tube is shown in FIG. 1, each bundle consists of a plurality of juxtapositoned tubes extending across the width of the enclosure in a direction perpendicular to the plane of the drawing. The tubes of each bundle are submerged in their respective beds to effect a heat transfer of liquid passing therethrough as will be described in detail later.

As mentioned above, air is passed into each bed through the plate 34 associated with each bed under control of the dampers 40 to fluidize the beds, it being understood that the velocity and rate of flow of the air passing through the beds is regulated so that it is high enough to fluidize the particulate fuel and to obtain economical burning or heat release rates per unit area of bed, yet is low enough to avoid the loss of too many fine fuel particles from the bed and to allow sufficient residence time of gases for good sulphur removal by a sorbent added to the fuel as also will be described in detail later.

A plurality of outlets 78 are provided in the rear wall 16 with each outlet being located in the upper portion of a corresponding compartment 36 and above the fluidized bed in the compartment. The heated air, after passing through the fluidized beds, combines with the combustion products from the beds and the resulting mixture, or gas (hereinafter referred to as the effluent gases) exits through the outlets 78 and flows into a heat recovery enclosure 80 disposed adjacent to, and to the rear of, the furnace section 12.

The heat recovery enclosure 80 is formed by a rear wall 82 and two sidewalls 84 and 86 (FIG. 2) which, together with the rear wall 16 of the furnace section form the boundary walls of the enclosure. As noted from FIG. 2 the walls 82, 84, and 86 are formed in an identical manner to the walls 14, 16, 18 and 20, i.e., they are formed by a plurality of vertically extending tubes having fins disposed on diametrically opposite portions thereof and extending for the entire length thereof, with the fins being connected together to render the tubes gas-tight.

Although not completely shown in the drawings, it is understood that headers are provided at each end of the walls 82, 84 and 86 which communicate with the tubes forming each wall in a manner identical to the walls 14, 16, 18 and 20. Also feeder tubes are provided with the headers associated with the walls 82, 84 and 86 and connect with downcomers and the like in order to enable the water to be passed through the complete length of the walls in a predetermined sequence to add heat to the water as will be described in detail later.

Figure 2:
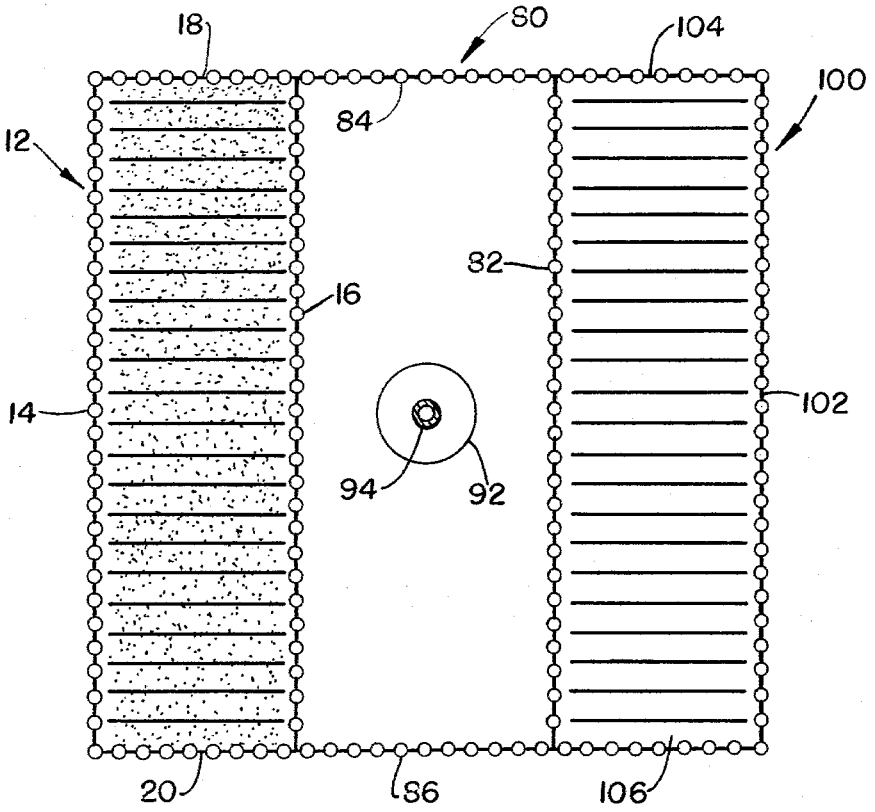
FIG. 2 is an enlarged sectional view taken along the line 2—2 of FIG. 1.

As shown in FIG. 2 by the dashed arrows, the effluent gases pass upwardly from the fluidized beds into the heat recovery enclosure 80 and then rise up and enter a cyclone-type dust separator 90 disposed in the upper portion of the heat recovery enclosure. The spearator 90 operates in a conventional manner to remove the fine particles, consisting largely of coal, from the effluent gases. A dust hopper 92 is in communication with the separator 90 by a conduit 94 which collects the fine particles separated from the effluent gases by the separator 90 and passes the same into an injector 96 which injects the particles back into the lowest compartment 36 in the furnace section 12, via a conduit 98. The particles are fluidized and burned in the latter compartment 36 in a manner similar to the particulate coal in the fluidized beds associated with the other compartments.

A convection enclosure, shown in general by the reference numeral 100, is disposed adjacent to, and to the rear of, the heat recovery enclosure 80. The convection enclosure includes a rear wall 102 and two sidewalls 104 and 106 (FIG. 2) which together with the rear wall 82 of the heat recovery enclosure 80 form the boundary walls of the enclosure. The walls 102, 104 and 106 are also formed by a plurality of vertically extending tubes having continuous fins disposed on diametrically opposite portions thereof and extending for the entire length thereof to render the enclosure gas-tight.

As noted from FIG. 1, the convection enclosure 100 has an inlet 108 which receives the dust free effluent gases from the outlet end of the separator 90, whereby the gases pass downwardly through the enclosure for discharge through an outlet 110. A plurality of headers, shown in general by the reference numeral 112 are provided in communication with the upper ends of the tubes forming the walls 102, 104, and 106, and a plurality of headers 114 are disposed at the lower ends of the tubes forming the latter walls. Feeder tubes 116 are provided which connect the headers 112 to a series of downcomers, one of which is shown by the reference numeral 118 in FIG. 1 and a plurality of feeder tubes 120 are provided to connect the headers 114 with the downcomers.

A tube bundle, shown in general by the reference numeral 122 is provided in the convection section so that feed water or the like can be passed, via an inlet header 124 into and through the tube bundle to preheat the water before it exits to an outlet header 126. A feeder tube 128 connects the outlet header 126 to the header 114 associated with the rear wall 102 of the convection enclosure 100 to pass the preheated water into the latter wall to initiate the sequential flow of the water through the boundary walls of the furnace section 12, the heat recovery enclosure 80 and the convection enclosure 100 as will be described in detail later.

It is noted that although the sidewalls of the furnace section in each of the enclosures 80 and 100 have been described separately, in actual practice they may be formed by two continuous spaced sidewalls spanning the furnace section 12, the heat recovery enclosure 80 and the convection enclosure 100 as shown, with the vertical size of the sidewalls spanning the convection enclosure, being less than that spanning the furnace section 12 and the heat recovery enclosure 80 as shown in FIG. 1. Also, although the two sidewalls that form the sidewalls 18, 84 and 104 and the sidewalls 20, 86 and 106 may be continuous, separate headers may be provided to break the flow up through each of the individual walls as described above.

In operation, air is introduced into the inlet 38 through the front wall 14 of the furnace section 12 whereby it passes through the dampers 40 and the distribution plates 34 associated with each compartment 36 and through the bed of particulate material in each compartment. Each bed is started up by firing an auxiliary gas burner or the like (not shown) to the minimum fuel ignition temperature so the fuel is combusted in each bed and will continue burning after startup. The heat exchange fluid, such as water, is introduced into the inlet header 124 associated with the tube bundle 120 in the convection enclosure 100 whereby it passes through the latter enclosure in heat exchange relation to the hot air passing in the opposite direction before it exits from the latter enclosure to the outlet header 126. From the outlet header 126 the fluid is then passed, by the feeder tube 128, to the header 114 associated with the rear wall 102 of the convection enclosure 100. After passing through the vertical length of the tubes forming the wall 102, the water passes through the tubes forming the walls of the convection section 100, the heat recovery section 80 and the furnace section 12 in the following sequence:

1. Through the sidewall 104 of the convection enclosure 100;
2. Through the sidewall 106 of the convection enclosure 100;
3. Through the rear wall 82 of the heat recovery enclosure 80;
4. Through the front wall 14 of the furnace section 12;
5. Through the sidewall 18 of the furnace section 12;
6. Through the rear wall 16 of the furnace section 12;
7. Through the sidewall 20 of the furnace section 12;
8. Through the sidewall 86 of the heat recovery enclosure 80; and
9. Through the sidewall 84 of the heat recovery enclosure 80.

It can be appreciated that, during this sequential passing of the water through the various walls, the water initially enters the inlet headers located at the lower ends of the tubes forming each wall and described in detail above and discharges through outlet headers disposed at the upper ends of the tubes forming each wall. To flow from one wall to the next, the water passes through the feeder tubes and downcomers, also described above, before entering the inlet headers associated with the wall of the next pass. In the interest of brevity, the detailed description of the specific passes of the fluid through these headers, feeder tubes, and downcomers has been omitted.

During the foregoing passes through the various walls, heat from the fluidized beds and the effluent gases is gradually added to the water which finally results in complete evaporation of the water into steam.

After passing through the final wall 84 associated with the heat recovery enclosure 80, and the downcomer, headers and feeder tubes associated therewith, the water is passed via the header 64 to and through the tube bundle 60. Additional heat is thus added to the steam from the fluidized bed in which the tube bundle 60 is located before the steam is passed, via the header 63, into and through the tube bundle 62, thereby raising the temperature of the steam to superheat. The superheated steam is then collected in the header 66 and passed out through the outlet 68 where it can be used for driving a steam turbine or the like.

The tube bundle 70 is provided to receive relatively low temperature steam which has previously been used in another stage of the plant such as a steam turbine, to raise its temperature for further use. In particular, the latter steam is received by the inlet 72 and passed, via a header 73, through the steam bundle 70 to raise the temperature of the steam before it exits via the header 73 and the outlet 74.

According to a preferred embodiment the particulate fuel is in the form of a mixture of crushed bituminous coal and limestone, with the latter functioning as a sorbent for the sulphur dioxide in combustion gases from the coal in accordance with conventional chemical theory. Since the low combustion temperatures and the low excess air requirements also reduce the nitrogen oxide from the combustion gas, the latter contains a minimum of pollutants.

There are many other advantages of the arrangement of the present invention. For example, the use of the vertical stacked compartments defined by continuous walls considerably reduces the manufacturing costs and time, since it minimizes headers, interconnecting piping, and downcomers yet permits a maximum use of the heat transfer surfaces involved. Of course, the free movement of the particulate fuel in the fluidized bed promotes rapid heat transfer both within the bed and between the bed and the submerged tube banks. As a result, bed temperatures are uniform and easy to control.

The provision of the separate heat recovery enclosure defined by additional water walls enables the convection surface to be independent of the geometry of the stacked walls so that it can be increased to the extent necessary to obtain an optimum heat transfer coefficient, while eliminating the need for relatively expensive tube bundles in each bed.

It is understood that variations can be made in the foregoing without departing from the scope of the invention. For example, the particular sequence of water flow through the tubes forming the aforementioned boundary walls can be varied, and can consist of some parallel flow through two or more of the walls.

A further latitude of modification, change and substitution is intended in the foregoing disclosure and in some instances some features of the invention will be employed with a corresponding use of other features. Accordingly, it is appropriate that the appended claims be construed broadly and in a manner consistent with the spirit and scope of the invention herein.

I claim:

1. A vapor generator comprising a furnace section, means defining a plurality of vertically aligned fluidized beds in said furnace section, one boundary wall of said furnace section having openings therein for permitting the discharge of effluent gases from said fluidized beds, means including said one boundary wall for defining a heat recovery enclosure adjacent said furnace section for receiving said effluent gases, and a convection enclosure disposed adjacent said heat recovery enclosure for receiving said effluent gases from said heat recovery enclosure and discharging said gases, each of the boundary walls of said furnace section, said heat recovery enclosure and said convection enclosure being formed by a plurality of interconnected tubes, and means for passing fluid through said boundary walls in a predetermined sequence to transfer heat from said fluidized beds to said fluid.

2. The vapor generator of claim 1, wherein two walls of said furnace section, said heat recovery enclosure and said convection enclosure are formed by two continuous walls spanning the depth of said generator.

3. The vapor generator of claim 1 further comprising heat exchange means submerged in each of said fluidized beds, and means for passing said fluid through said heat exchange means to add additional heat to said fluid.

4. The vapor generator of claim 1 further comprising heat exchange means disposed in said convection enclosure and means for passing said fluid through said heat exchange means for preheating said fluid before it is passed to said boundary walls.

5. The vapor generator of claim 1 further comprising means in said heat recovery enclosure for receiving said effluent gases from said beds and separating solid particles from said gases before the gases are passed to said convection enclosure.

6. The vapor generator of claim 5 further comprising means in said heat recovery enclosure for passing said solid particles back to one of said fluidized beds for burning the carbon in said solid particles.

7. The vapor generator of claim 1, wherein said furnace section includes a front wall, a rear wall and two sidewalls, said openings being formed in said rear wall.

8. The vapor generator of claim 7, wherein said heat recovery enclosure is formed by two sidewalls and a rear wall and by said rear wall of said furnace section.

9. The vapor generator of claim 8, wherein said convection enclosure is formed by two sidewalls and a rear wall and by said rear wall of said heat recovery enclosure.

10. The vapor generator of claim 9, wherein said sidewalls of said furnace section, said heat recovery enclosure and said convection enclosure are all formed by two continuous walls each spanning the entire depth of said vapor generator.

11. The vapor generator of claim 10, wherein the heights of said furnace section of said heat recovery enclosure are substantially the same and are greater than the height of said convection enclosure, with said sidewalls being sized accordingly.

12. The vapor generator of claim 9, wherein the roof of said furnace section, said heat recovery enclosure and said convection enclosure is formed by a single continuous wall spanning the entire width of said vapor generator.

13. The vapor generator of claim 1, wherein the area above each fluidized bed is devoid of any heat exchange surfaces other than those provided by said walls.

14. The vapor generator of claim 1 wherein said convection enclosure shares a common wall with said heat recovery enclosure.

15. A vapor generator comprising a furnace section, means defining a plurality of vertically aligned fluidized beds in said furnace section, one boundary wall of said furnace section having openings therein for permitting the discharge of effluent gases from said fluidized beds, means including said one boundary wall for defining a heat recovery enclosure adjacent said furnace section for receiving said effluent gases, and a convection enclosure disposed adjacent said heat recovery enclosure for receiving said effluent gases from said heat recovery enclosure and discharging said gases, each of the boundary walls of said furnace section, said heat recovery enclosure and said convection enclosure being formed by a plurality of interconnected tubes, means for passing fluid through said boundary walls in a predetermined sequence to transfer heat from said fluidized beds to said fluid, heat exchange means disposed in said convection enclosure, and means for passing said fluid through said heat exchange means for preheating said fluid before it is passed to said boundary walls.

16. A vapor generator comprising a plurality of interconnected boundary walls defining a furnace section, means defining a plurality of vertically aligned fluidized beds in said furnace section, one boundary wall of said furnace section having openings therein for permitting the discharge of effluent gases from said fluidized beds, a plurality of additional boundary walls cooperating with said one boundary wall for defining a heat recovery enclosure adjacent said furnace section for receiving said effluent gases, and a plurality of additional boundary walls cooperating with a boundary wall of said heat recovery enclosure to define a convection enclosure adjacent said heat recovery enclosure for receiving said effluent gases from said heat recovery enclosure and discharging said gases, each of the boundary walls of said furnace section, said heat recovery enclosure and said convection enclosure being formed by a plurality of interconnected tubes, and means for passing fluid through said boundary walls in a predetermined sequence to transfer heat from said fluidized beds to said fluid.

17. The vapor generator of claim 16, wherein two boundary walls of said furnace section, said heat recovery enclosure and said convection enclosure are formed by two continuous walls spanning the depth of said generator.

18. The vapor generator of claim 16 further comprising heat exchange means disposed in said convection enclosure and means for passing said fluid through said heat exchange means for preheating said fluid before it is passed to said boundary walls.

19. The vapor generator of claim 16 further comprising means in said heat recovery enclosure for receiving said effluent gases from said beds and separating solid particles from said gases before the gases are passed to said convection enclosure.

20. The vapor generator of claim 19 further comprising means in said heat recovery enclosure for passing said solid particles back to one of said fluidized beds for burning the carbon in said solid particles.

21. The vapor generator of claim 16 wherein said boundary walls defining said furnace section includes a front wall, a rear wall and two sidewalls, said openings being formed in said rear wall.

22. The vapor generator of claim 21 wherein said boundary walls defining said heat recovery enclosure include two sidewalls connected to said rear wall of said furnace section and a rear wall connected to said latter sidewalls.

23. The vapor generator of claim 22 wherein said boundary walls defining said convection enclosure include two sidewalls connected to said rear wall of said heat recovery enclosure and a rear wall connected to said latter sidewalls.

24. The vapor generator of claim 23, wherein said sidewalls of said furnace section, said heat recovery enclosure and said convection enclosure are all formed by two continuous walls each spanning the entire depth of said vapor generator.

25. The vapor generator of claim 24 wherein the heights of said furnace section of said heat recovery enclosure are substantially the same and are greater than the height of said convection enclosure, with said sidewalls being sized accordingly.

26. The vapor generator of claim 23 wherein the roof of said furnace section, said heat recovery enclosure and said convection enclosure is formed by a single continuous wall spanning the entire width of said vapor generator.

27. The vapor generator of claim 16 wherein the area above each fluidized bed is devoid of any heat exchange surfaces other than those provided by said walls.

* * * * *